US005395078A

United States Patent [19]

Gellender

[11] Patent Number: 5,395,078

[45] Date of Patent: Mar. 7, 1995

[54] LOW SPEED WHEEL PRESENCE TRANSDUCER FOR RAILROADS WITH SELF CALIBRATION

[75] Inventor: Edward P. Gellender, Jericho, N.Y.

[73] Assignee: Servo Corporation of America, Hicksville, N.Y.

[21] Appl. No.: 114,755

[22] Filed: Sep. 1, 1993

Related U.S. Application Data

[63] Continuation-in-part of Ser. No. 803,602, Dec. 9, 1991, abandoned.

[51] Int. Cl.[6] ..... B61L 1/08

[52] U.S. Cl. ..... 246/249; 324/179

[58] Field of Search ..... 246/169 R, 169 A, 246, 246/249, 250; 361/180; 324/173, 179, 234, 207.13

[56] References Cited

U.S. PATENT DOCUMENTS

| | | | |
|---|---|---|---|
| 3,151,827 | 10/1964 | Gallagher et al. | 246/249 |
| 3,721,821 | 3/1973 | Blanyer | 246/249 |
| 4,283,031 | 8/1981 | Finch | 246/249 X |
| 4,379,330 | 4/1983 | Sanville | 246/249 |
| 4,524,932 | 6/1985 | Bodziak | 246/249 X |
| 4,727,372 | 2/1988 | Buttemer | 246/249 X |

*Primary Examiner*—Michael S. Huppert
*Assistant Examiner*—Scott L. Lowe
*Attorney, Agent, or Firm*—Kane, Dalsimer, Sullivan, Kurucz, Levy, Eisele and Richard

[57] ABSTRACT

A railroad car wheel transducer includes a coil positioned along a rail of a track. The presence of a wheel proximal to the coil causes basic electrical characteristics of the coil, such as its inductance and Q factor to change, which is sensed and used to generate a coil signal. A calibrating circuit monitors the coil characteristics to compensate for long term drifts.

16 Claims, 3 Drawing Sheets

LOW SPEED WHEEL PRESENCE TRANSDUCER FOR RAILROADS WITH SELF CALIBRATION

This is a continuation-in-part to application Ser. No. 803,602, filed Dec. 9, 1991, now abandoned.

BACKGROUND OF THE INVENTION

A. Field of Invention

This invention pertains to a transducer for sensing the wheels of a railroad car moving along a track, and more particularly to a transducer capable of sensing said wheel even at very low speeds which transducer includes a self-calibration feature compensating for long term baseline voltage drifts.

B. Description of the Prior Art

Wheel transducers are used frequently along railroad tracks for detecting the wheels of a moving car, frequently in conjunction with safety equipment. For example, railroad crossings are frequently equipped with automatic gates coupled to wheel transducers. The gates close when the wheels of a train are detected by a transducer, and then open after the train passes. Other safety equipment such as bearing and wheel heat sensors are also activated by such transducers upon determining the approach of a train. One such detector is disclosed in U.S. Pat. No. 3,151,827 to Gallagher. One problem with the wheel transducer described in the Gallagher patent has been that the transducer cannot detect with certainty the wheels of a train moving at relatively slow speeds such as below approximately 6 mph. A further problem with prior art transducers has been that a single transducer cannot indicate the direction of movement of a train and hence a pair of spaced apart transducers has been required to determine train direction from the sequence of activation.

Other transducers are known which can detect slow moving trains, however these transducers produce a baseline voltage which tends to drift from a normal level because of temperature changes and other variables affecting the performance of the transducer components. As a result the prior art transducer needed periodic recalibration. The elimination of this drift is particularly important in zero-speed wheel transducers, i.e. transducers with the capability of detecting a train moving very slowly or stopped for an indefinite time period. These types of transducers require a true D.C. coupling and any slow drift in the baseline voltage is indistinguishable from and therefore erroneously interpreted as a slow-moving train.

OBJECTIVES AND SUMMARY OF THE INVENTION

In view of the above-mentioned disadvantages of the prior art, it is an objective of the present invention to provide a self-calibrated wheel transducer which detects railroad car wheels which are moving at a very slow speed, or even at stand-still.

A further objective is to provide a wheel transducer which include a self-calibration circuit for maintaining the baseline voltage within a preset range independent of external conditions.

Yet a further objective is to provide a transducer which can be packaged in a housing of the same size as prior art transducers thereby minimizing retrofitting costs. Other objectives and advantages of the present invention shall become apparent from the following description.

Briefly, a wheel transducer constructed in accordance with this invention includes two coils constructed and arranged to be disposed on a track rail so that their impedance changes when a wheel passes over the rail. Quadrature reference signals are fed to the coils and their response to the reference signals is monitored through a differential phase detector. The resulting signal is indicative not only of the presence of a wheel but also its direction of movement.

The output of the differential phase detector is calibrated to eliminate baseline voltage drifts. For this purpose, the baseline voltage is monitored and if it drifts outside a preselected range, an offset voltage is added to the baseline voltage to eliminate the drift. The output of the differential phase detector changes rapidly when a wheel is detected, and therefore when a rapid output voltage is sensed at the detector output, the self-calibration function is also disabled.

DETAILED DESCRIPTION OF THE INVENTION

Figure 1:
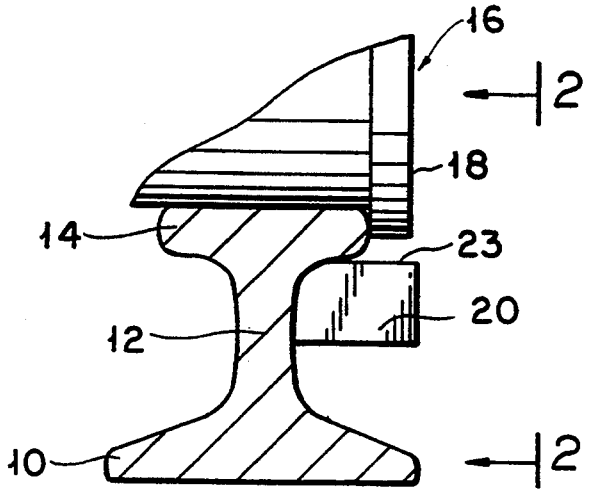
FIG. 1 shows a side elevational view of a rail with a wheel transducer constructed in accordance with this invention.
Figure 2:
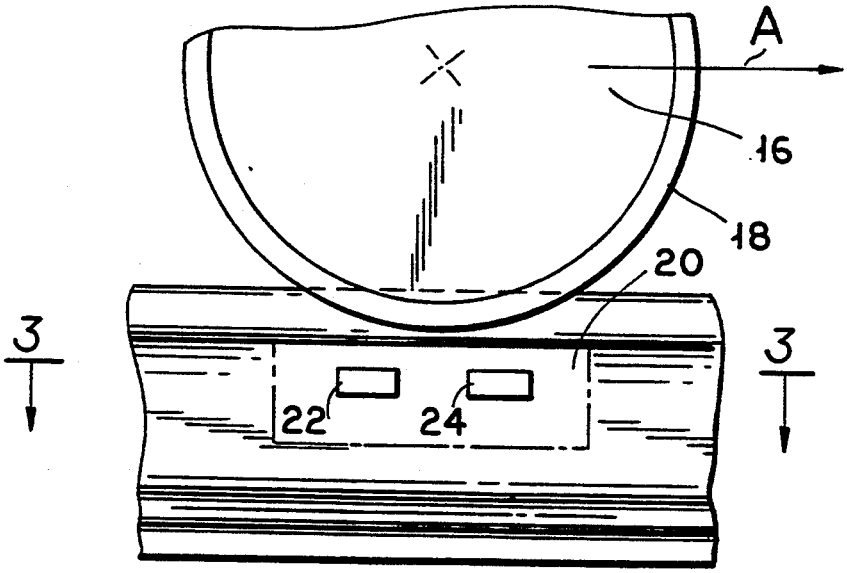
FIG. 2 shows a front view of the rail of FIG. 1.
Figure 3:
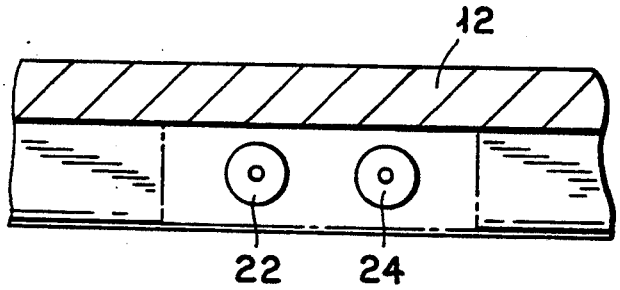
FIG. 3 shows a plan view of the rail and transducer of FIG. 1.

FIGS. 1–3 show a typical railroad track 10 having a web 12 and a head 14. A wheel 16 rolls over the track 10 with a flange 18 disposed on one side of the head 14. A transducer 20 is disposed under the head on the side of flange 18 and secured to the web 12 of the track (by screws or a clamp not shown).

As indicated somewhat schematically in FIGS. 2 and 3 the transducer 20 includes two coils 22, 24 disposed in a common housing 23 at a preselected distance apart from each other and arranged with their axis normal to the rail. For example the two coils may be spaced about 4–½" apart. Each coil 22, 24 has a diameter of about 2" or 2½" and is ½" thick and is wound to form an inductor having an inductance of about 7.88 mH. The coils do not have any cores. As shown in FIGS. 1–3, each coil 22, 24 is positioned so that its electrical characteristics are affected by a large metallic object such as steel wheel 16 passing along the track over the transducer. More particularly, the presence of flange 18 increases the inductance of the coil by about 5% and at the same time drastically reduces its Q factor. This change in the electrical characteristics of the coil is used by a circuit 26 also disposed in housing 23 to determine not only the presence of wheel 16 but also its direction of movement as described below.

Figure 4:
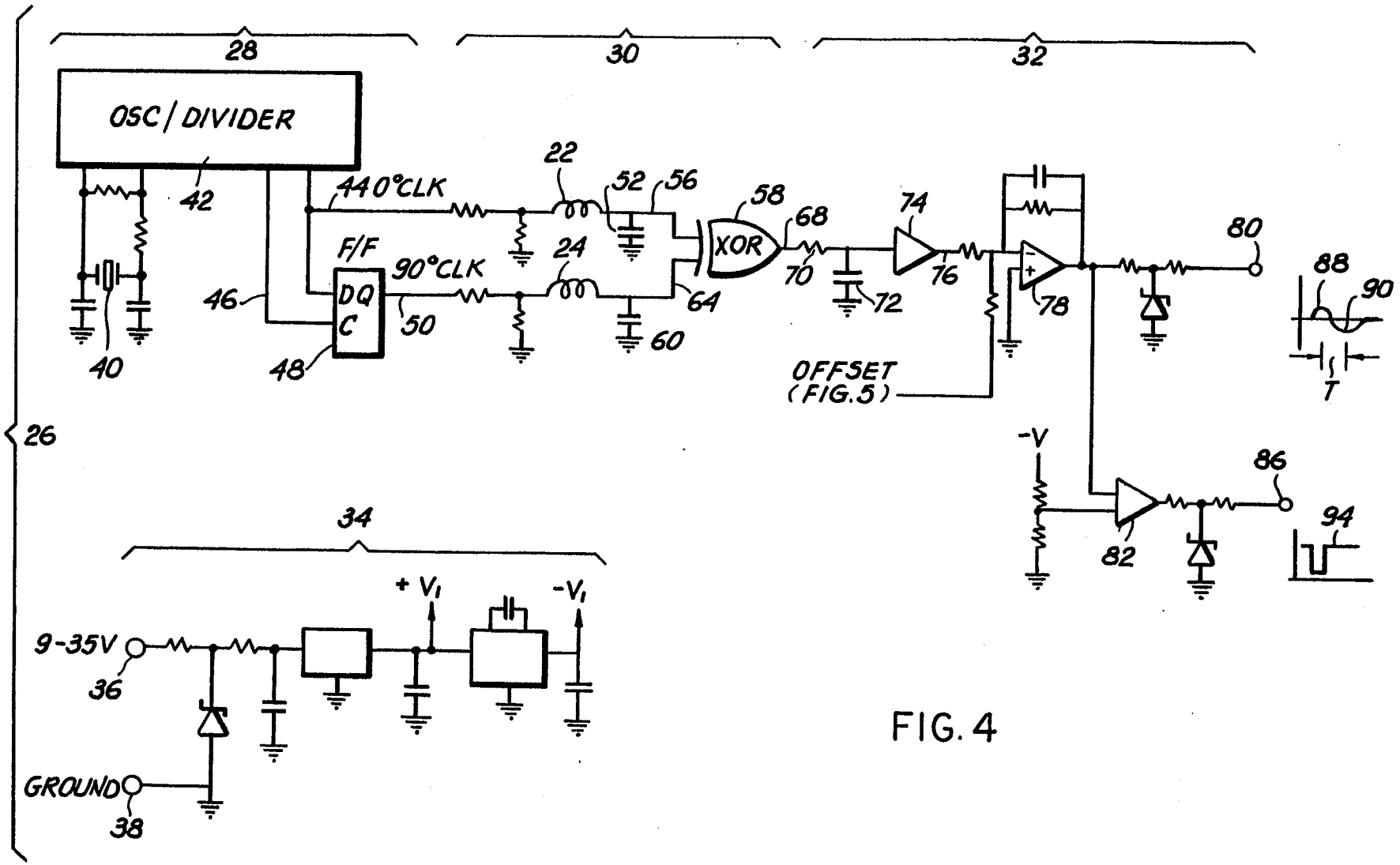
FIG. 4 shows a schematic diagram for the transducer.

Circuit 26 shown in FIG. 4 includes three stages 28, 30, 32 as well as a power supply 34. The power supply is powered from a pair of dc lines 36, 38 generally available along most right of ways and is used to generate the proper dc voltages for the various elements of circuit 26.

Stage 28 is an ac generator stage used to generate two quadrature reference signals. For this purpose a crystal 40 is coupled to an IC 42 which may be for example an MC 14060. Crystal 40 and IC 42 cooperate to generate a first reference signal 0° CLK on line 44 connected to one of the outputs of IC 42. Crystal 40 has a frequency of 3.5795 MHz and the first reference signal has a frequency of 55.930 KHz. Another line 46 is connected to a second output of IC 42 to feed a signal to a flip-flop 48. Flip-flop 48 is used to generate a second reference signal 90° CLK on line 50 having the same frequency as signal on line 44 but which is offset by a phase angle of 90°.

Stage 30 is a differential phase detection stage used to sense the change in the electrical characteristics of the two coils 22, 24. As shown in FIG. 4, coil 22 forms a low-pass filter with capacitor 52. This filter receives the first reference signal as an input from line 44 and generates an output fed on line 56 to the input of a XOR gate 58. Similarly a low pass filter consisting of coil 24 and capacitor 60 receives the second reference signal from line 50 and feeds it on line 64 to the second input of XOR gate 58. Thus, XOR gate compares the phases of the signals from the coils 22, 24.

Stage 32 is an output stage used to generate different outputs compatible with different wheel detection systems. In this manner the transducer 20 can be used to replace several different types of wheel detectors. In stage 32, the output 68 of XOR gate 58 is fed to a low pass filter network formed of a resistor 70, a capacitor 72 and an amplifier 74. The filtered signal, 76 is coupled to the inverting input of amplifier 78.

Amplifier 78 receives an offset voltage to compensate for drift in the amplifier output as described below. The output of amplifier 78 is coupled to output port 80 of stage 32, and to the input of an amplifier 82. The output of amplifier 82 is coupled to a second output port 86.

Circuit 26 operates as follows. When a train wheel is not disposed above detector 20, the two quadrature reference signals on lines 44, 50 have basic electrical characteristics which include a constant phase difference of 90°. Therefore the output of XOR gate 58 is constant at zero. If a wheel 16 passes over the detector from left to right (i.e. in direction A shown in FIG. 2), it first changes sequentially the inductance and the Q factor of coil 22 and then of coil 24. The combined effect in these electrical characteristics of coil 22 causes a phase shift on line 56 which is sensed by the XOR gate 58 acting as a differential phase detector to produce a positive pulse. This pulse is filtered by resistor 70 and capacitor 72 to remove ripples and amplified resulting in pulse 88 (shown at output port 80). When the wheel 16 passes over the second coil 24 a negative pulse 90 is generated. The period T between the peak amplitudes of these pulses is related to the speed of the wheel. Thus if necessary, the output of the detector may also be used to monitor the speed of a train. At 120 mph, this period T is 2.1 msec. However, the values of these peak amplitudes are independent of the speed of the wheel. Therefore the detector disclosed herein is effective at very low (or zero) speeds. If the wheel is moving in the opposite direction, the order of the pulses is reversed, i.e. negative pulse 90 precedes positive pulse 88.

The amplifier 78 is biased so that the waveform at output port 80 is essentially at ground when no wheel is detected and is calibrated so that this output remains essentially unchanged without the need for any adjustments. Amplifier 78 can optionally be used to add an off-set voltage of V/2 to the signal on port 80. Finally for certain applications, a detector must provide a current sink in the presence of a wheel. For these applications port 86 may be used which generates the signals shown at 94.

Figure 5:
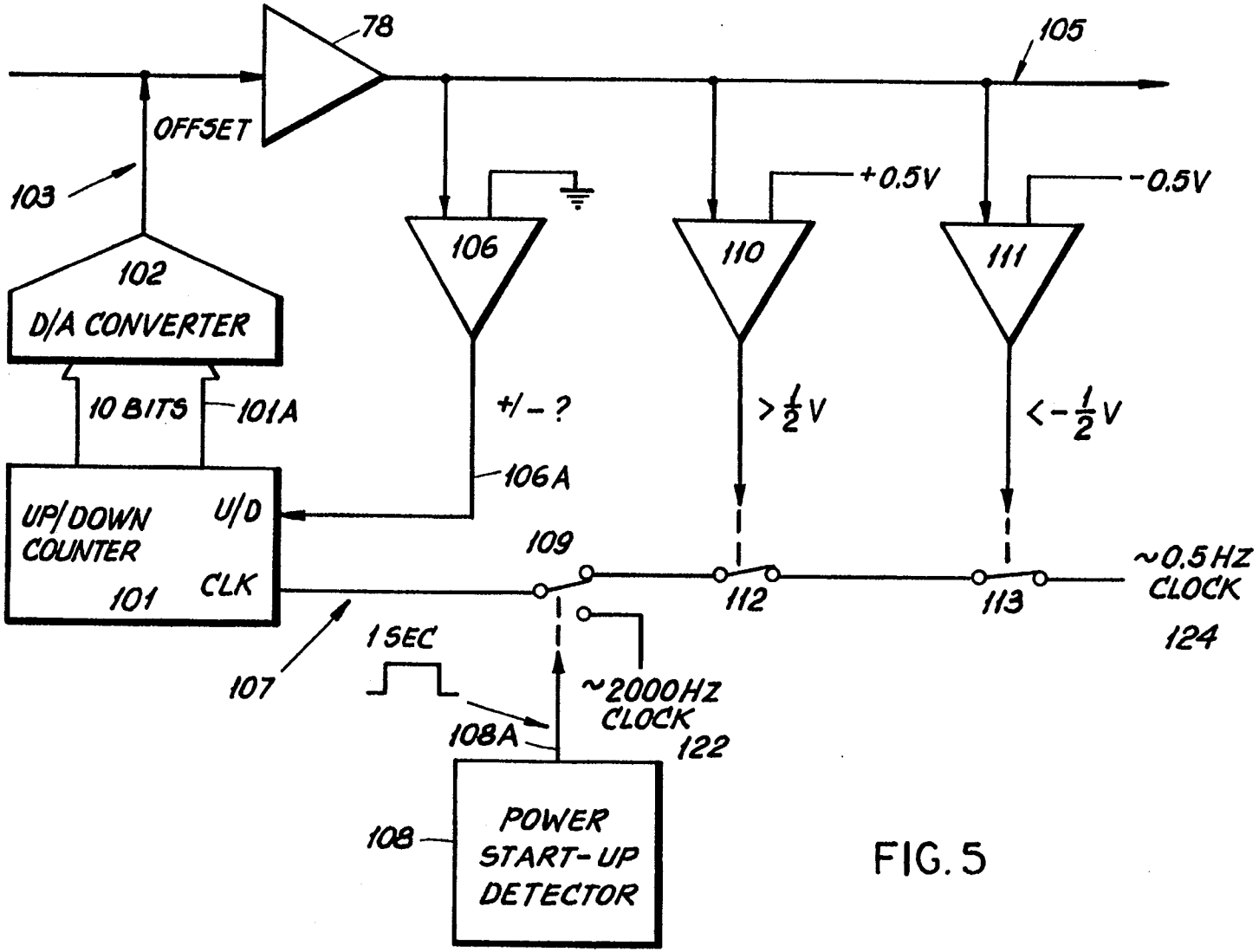
FIG. 5 shows a schematic diagram for the self-calibration feature.

As previously mentioned, an important feature of the present invention is self-calibration which is accomplished as follows. Amplifier 78 generates an output which ranges from ±1.5 volts to ±5 volts in the presence of a train wheel. The maximum voltage level depends on the clearance between the transducer and the wheel, in turn determined by the size of the wheel flange, the installation of the transducer housing, and the wear of the wheel and rail. Amplifier 78 receives two inputs: the filtered phase-voltage signal from amplifier 74, and an offset voltage signal, selected so that the baseline voltage when no train is present, i.e. the baseline voltage at the amplifier output, is maintained at a preselected level or range, such as for example 0±0.10 v. The circuitry for implementing this feature is shown in FIG. 5. It consists of an up/down counter 101, a comparator 106 and a digital-to-analog converter 102.

Comparator 106 monitors the voltage on line 105, i.e. the output of amplifier 78. If this voltage is of positive polarity, the comparator 106 generates a positive output on line 106A to counter 101.

Counter 101 is preferably a ten bit counter. Its output is fed on a parallel bus 101A to the converter 102. Counter 101 counts clock pulses received on its CLK input port from a line 107. The counter 101 also has an up/down counting control port. Depending on the control signal received by this port from line 106A, the counter either increments or decrements its output to converter 102 by one each time it receives a clock pulse on line 107. The output of converter 102 forms the offset voltage for amplifier 78.

In this manner the comparator 106 steers the counter to count up or down to cause a corresponding change of ±0.010 volts in the baseline voltage on line 105. The clock signals on line 107 originate from either a 2 Khz generator 122 or a 0.5 Hz generator 124 as determined by a double pole electronic switch 109. Electronic switch 109 is controlled by a power start up sensor 108. The 0.5 Hz signal from generator 124 is fed to switch 109 through two single pole electronic switches 112, 113 arranged in series, each of these switches being controlled by a respective comparator 110, 111. Comparators 110, 111 also monitor the voltage on line 105. Comparator 110 opens switch 112 if it detects that the voltage on line 105 has exceeded 0.5 volts. Similarly, comparator 111 opens switch 113 if it senses that the voltage on line 105 drops below −0.5 volts.

The self-calibration circuitry of FIG. 5 operates as follows. Under quiescent conditions, i.e. when no train is detected, comparator 106 generates either a high or low logic level negative on line 106A to maintain the baseline voltage on line 105 to 0±0.010 volts. If the baseline voltage drifts below this range, the count in counter 101 is incremented by one at the next clock pulse thereby increasing the offset voltage on line 103 by 0.01 volts. This offset voltage is added by amplifier 78 to the filtered phase difference voltage thereby causing the baseline voltage to return to the designated range. If the baseline voltage drifts above the designated range, the count is decremented. Thus, long term drifts in the baseline voltage are automatically compensated.

Advantageously, when the circuit is started up, detector 108 generates a one second pulse on line 108A causing line 107 to be switched to the 2 Khz generator 122 through switch 109. In this manner, because the clock pulses on line 107 during start up are frequent, the voltage on line 105 quickly converges to the designated range. After one second, switch 109 connects line 107 to the 0.5 Hz generator 124 and hence the adjustment in baseline voltage occurs at the much slower rate. This rate has been selected to insure that the calibration circuit does not eliminate an actual wheel detection signal.

When a wheel is indicated by the filtered phase difference voltage, the voltage on line 105 rises or falls beyond the ±0.5 volt limit set by comparators 110, 111 much faster than the rate of the signals from clock generator 124. As a result, either switch 112, or 113 opens, depending on the direction of movement of the train, thereby suspending the clock signals to counter 101. After the wheel passes, the voltage 105 returns to its baseline and the respective switch 112, 113 closes allowing the calibration circuit to resume operation.

It has been found that when a train is creeping at 1 mph or slower, because of the combined effects of friction, and coupling between the cars, its wheels are not moving in a continuous manner but rather they are jerked in increments of about 1 foot. Hence even for very slow moving vehicle, the filtered difference voltage rises fast enough to be interpreted as a wheel detection signal and not as a drift to be eliminated by the calibration circuit.

Even if a wheel happens to stop right on top the transducer, the voltage on line 105 rises rapidly enough to disable the calibration circuit. After the wheel moves away, calibration is resumed.

It has been found that the self-calibrated transducer system described above operated successfully over a temperature range of −40° to +85° C. and compensates for drifts in the baseline voltage.

Obviously numerous modifications may be made to the invention without departing from its scope are defined in the appended claims.

We claim:

1. A wheel presence transducer comprising:

wheel detector means for generating a wheel detection signal;

an amplifier having an input receiving said wheel detection signal and an offset signal and an output for generating an amplifier output signal corresponding to the difference between said wheel detection and offset signal, said amplifier output signal being indicative of a detected wheel; and offset signal generating means including a comparator for comparing said amplifier output signal to a preselected range and a counter responsive to said comparator for generating said offset signal when said amplifier output signal is outside said preselected range whereby said amplifier corrects said output signal with said offset signal to eliminate drifting.

2. The transducer of claim 1 wherein said signal generating means further includes an A/D converter for converting said count into an analog signal.

3. The transducer of claim 1 wherein said wheel detector means includes a first coil and a second coil spaced part at a preselected distance, said coils having an electrical parameter which changes in the presence of a train wheel; and sensing means for sensing said change for generating a first coil signal and a second coil signal.

4. The transducer of claim 3 further comprising a differential amplifier for generating a difference corresponding to a difference between said first and second coils.

5. The transducer of claim 1 further comprising clock generator mean for generating a clock signal, said counter being arranged to count said clock signal.

6. The transducer of claim 5 further comprising electronic switching means for selectively disabling said clock signal.

7. The transducer of claim 6 wherein said electronic switching means includes comparator means for monitoring said amplifier output signals and an electronic switch which disables said clock signal if said output signal is outside a preselected range.

8. The transducer of claim 5 wherein said clock generator means generates a first clock at a first rate, a second clock signal at a second rate higher than said first rate, and selection means for selectively feeding one of said first and second clock signals to said counter.

9. The transducer of claim 8 further comprising a power up detector for sensing when power is applied, said power up detector controlling said selection means.

10. A wheel transducer comprising:

wheel detector means for generating a wheel detection signal;

an amplifier having an input receiving said wheel detection signal and an offset signal and an output for generating an amplifier output signal; and offset signal generating means for generating said offset signal when said amplifier output signal is outside a preselected range whereby said amplifier corrects said output signal with said offset signal to eliminate drifting;

wherein said offset signal generating means includes comparator means for comparing said amplifier output signal to a preselected value to generate a comparator signal and a signal generator generating said offset signal corresponding to said comparator signal; and wherein said signal generator includes a counter responsive to said comparator for generating a count.

11. A wheel transducer comprising:

wheel detector means for generating a wheel detection signal in the presence of a wheel;

an amplifier having a first input receiving said wheel detection signal, a second input receiving an offset signal and an output for generating an output signal;

offset signal generating means for generating said offset signal when said amplifier output signal is outside a first preselected range whereby said amplifier corrects said output signal with said offset signal; and offset disabling means generating an offset disabling signal for disabling said offset signal generating means when said wheel is detected.

12. The apparatus of claim 11 wherein said offset disabling means includes comparator means coupled to said output signal for generating an offset disabling signal when said output signal is outside a second preselected range.

13. The apparatus of claim 11 wherein said offset disabling means generates said offset disabling signal when said output signal changes by at least a preselected amount in a preselected time period.

14. The apparatus of claim 11 wherein said offset generating means updates said offset signals periodically in accordance with one of a first and a second clock single wherein said second clock signal has a frequency higher than said first clock signal.

15. The apparatus of claim 14 further comprising selection means for selecting one of said first and second clock signals for said offset generating means.

16. The apparatus of claim 15 further comprising power up detection means for detecting a power up of said transducer, said power up detection means generating a power up signal to said selection means, wherein said selection means selects said second clock in response to said power up signal.

* * * * *